US006976619B2

(12) United States Patent
Beacham et al.

(10) Patent No.: US 6,976,619 B2
(45) Date of Patent: Dec. 20, 2005

(54) COMPARTMENTED PIGGY BANK

(76) Inventors: Susan P. Beacham, 630 Meadowood Dr., Lake Forest, IL (US) 60045; Michael L. Beacham, 630 Meadowood Dr., Lake Forest, IL (US) 60045

( * ) Notice: Subject to any disclaimer, the term of this patent is extended or adjusted under 35 U.S.C. 154(b) by 87 days.

(21) Appl. No.: 10/604,900

(22) Filed: Aug. 26, 2003

(65) Prior Publication Data

US 2005/0045709 A1 Mar. 3, 2005

(51) Int. Cl.[7] ..... A47G 29/00
(52) U.S. Cl. ..... 232/4 R; 446/8; 109/53; 206/0.84
(58) Field of Search ..... 232/4 R, 43.1; 446/8; D99/37–38; 109/53, 55; 206/0.84, 206/0.83

(56) References Cited

U.S. PATENT DOCUMENTS

| | | | | |
|---|---|---|---|---|
| 529,228 | A | | 11/1894 | Wyler |
| 1,644,495 | A | | 10/1927 | Shafer |
| 1,716,823 | A | | 6/1929 | Eune |
| 2,510,884 | A | | 6/1950 | Greene |
| D170,574 | S | | 10/1953 | Hickey |
| 3,215,304 | A | | 11/1965 | Rohe |
| 3,313,477 | A | | 4/1967 | Brown |
| 3,992,805 | A | | 11/1976 | Arkin |
| D303,035 | S | | 8/1989 | O'Dunlaing |
| D354,831 | S | | 1/1995 | Anderson |
| 5,482,487 | A | | 1/1996 | Harris |
| D385,598 | S | | 10/1997 | Stephensen et al. |
| D390,332 | S | | 2/1998 | Searls |
| 5,716,211 | A | | 2/1998 | Vetter |
| D436,427 | S | | 1/2001 | Grendahl |
| D445,446 | S | * | 7/2001 | Knox et al. ..... D18/3.1 |
| D458,727 | S | | 6/2002 | Beacham |
| 6,554,692 | B2 | * | 4/2003 | Knox et al. ..... 453/3 |

* cited by examiner

*Primary Examiner*—William L. Miller
(74) *Attorney, Agent, or Firm*—Clausen Miller, P.C.

(57) ABSTRACT

A compartmented bank for holding money to be used for saving, spending, donating, investing or other budgetary purposes. The bank is shaped like an animal and comprises a hollow body and four feet. Each compartment communicates with one of the feet so that money deposited into each compartment can be dispensed through an opening in a corresponding foot. The external surface of the body bears indicia indicating the budgetary purpose of the money placed in each compartment.

7 Claims, 6 Drawing Sheets

COMPARTMENTED PIGGY BANK

BACKGROUND OF INVENTION

This patent relates to a savings bank. More specifically, this patent relates to a compartmented savings bank in the shape of a pig or other multiple-legged animal wherein the money is dispensed through the legs of the animal.

Numerous savings banks are known in the art. Most of these feature a single compartment for storing coins. Some banks feature multiple compartments for storing money for different purposes, such as Shafer U.S. Pat. No. 1,644,495, Eune U.S. Pat. No. 1,716,823, Arkin U.S. Pat. No. 3,992,805, Vetter U.S. Pat. No. 5,716,211 and Anderson U.S. Pat. No. Des. 354,831.

Shafer U.S. Pat. No. 1,644,495 discloses a lidded rectangular box into which are placed smaller boxes bearing indicia indicating the purpose to which the money stored in that particular box will be used.

Eune U.S. Pat. No. 1,716,823 discloses a rectangular box comprising rows of smaller boxes, each bearing marking on its top cover indicating the suggested use of money placed in that box.

Arkin U.S. Pat. No. 3,992,805 discloses a coin bank having a hollow base shaped like a bird's nest, slide drawers mounted in the base, and bird figures on the base. Each bird figure includes a coin slot and bears a label indicative of a particular budgetary purpose, such as "Saving", "Spending" and "Sharing." The interior of the bank is divided into multiple compartments, each compartment communicating with one of the coin slots. The drawers can be used to access the money in the compartments.

Vetter U.S. Pat. No. 5,716,211 discloses a multiple compartment savings bank. Each compartment is shaped like a figure representative of the purpose for which money placed in that compartment will be used, such as a boat (retirement), a house (housing), a figure wearing a mortar board (college) and a pig (spending).

Anderson Des. 354,831 discloses a compartmented coin bank in which each compartment is labeled for a different budgetary purpose. The four compartments disclosed in the patent are labeled "Goal", "Giving", "Savings" and "Fun" respectively.

None of these patents disclose a compartmented savings bank in the shape of a pig or other multiple-legged animal wherein the money is dispensed through the legs of the animal. It is the primary object of the present invention to provide such a bank.

Another object of the present invention is to provide a bank that enables the user to save money for multiple purposes.

Still another object of the present invention is to provide a bank that can be used to help teach young persons how to manage money.

Further and additional objects will appear from the description, accompanying drawings, and appended claims.

SUMMARY OF INVENTION

The present invention is a bank for holding coins and bills to be used for multiple purposes such as saving, spending, donating and investing. The bank comprises a hollow body shaped like an animal and divided into multiple compartments. A deposit slot on the exterior of the animal communicates with each compartment. The external surface of the animal body bears indicia indicating the purpose to which money placed in each compartment will be used, such as the words "SAVE", "SPEND", "DONATE" and "INVEST". Each word or symbol is arranged on a portion of the external surface corresponding to one of the four compartments. In a key aspect of the invention, the money may be dispensed (removed) through the legs of the animal.

DETAILED DESCRIPTION

Figure 1:
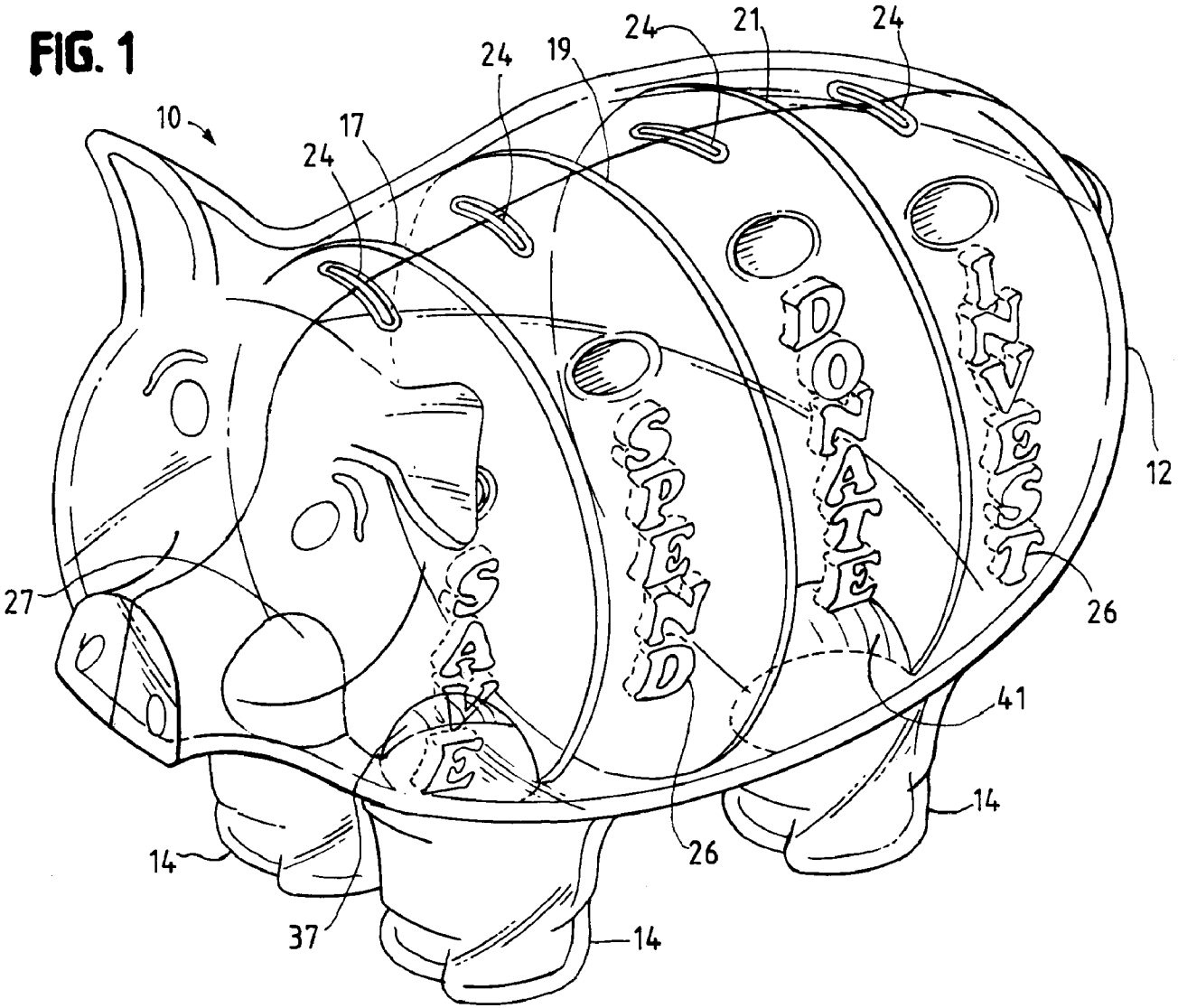
FIG. 1 is a perspective view of a compartmented bank according to the present invention.
Figure 2:
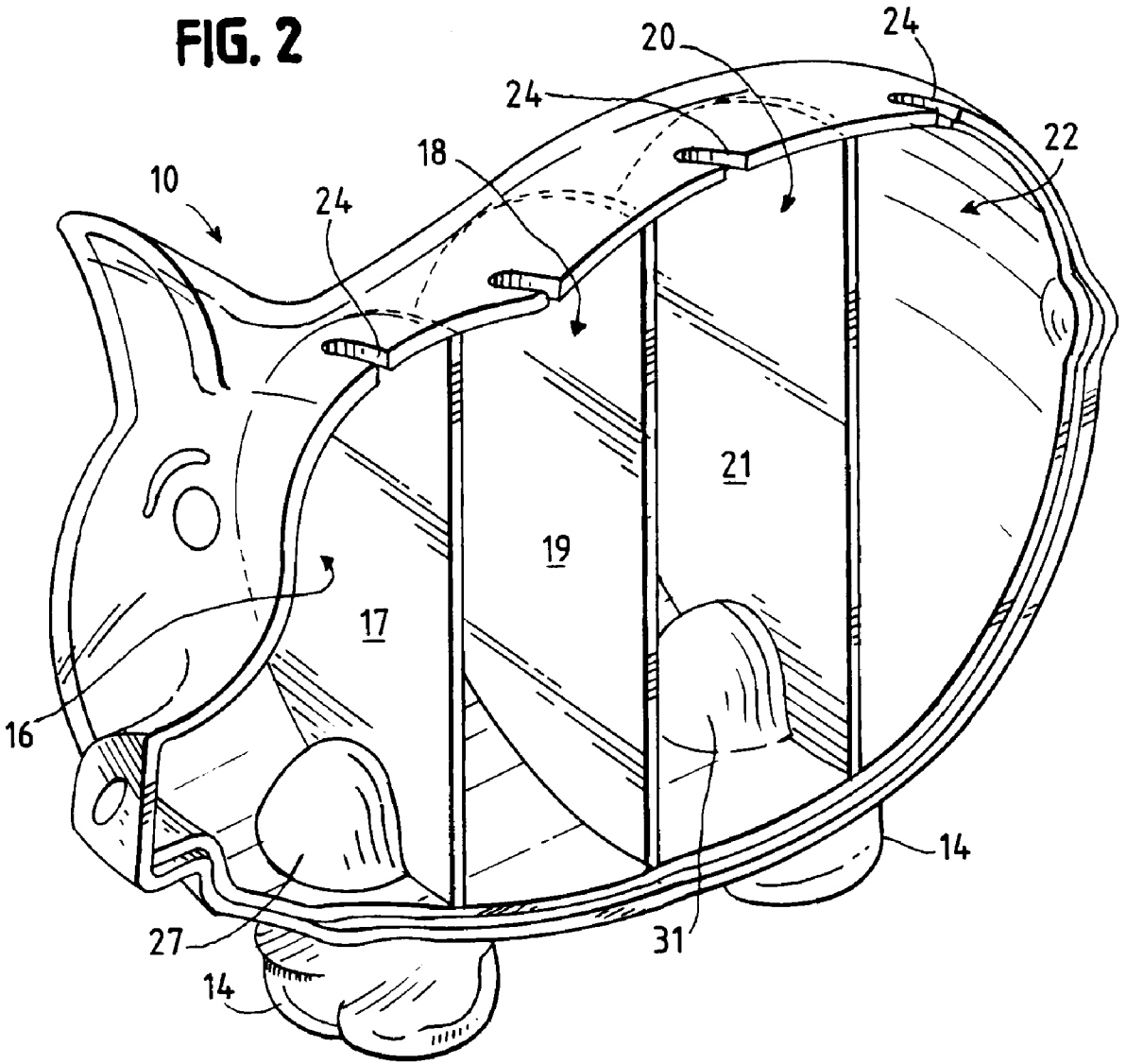
FIG. 2 is a cross-sectional view of the bank of FIG. 1 taken along line 2—2.
Figure 3:
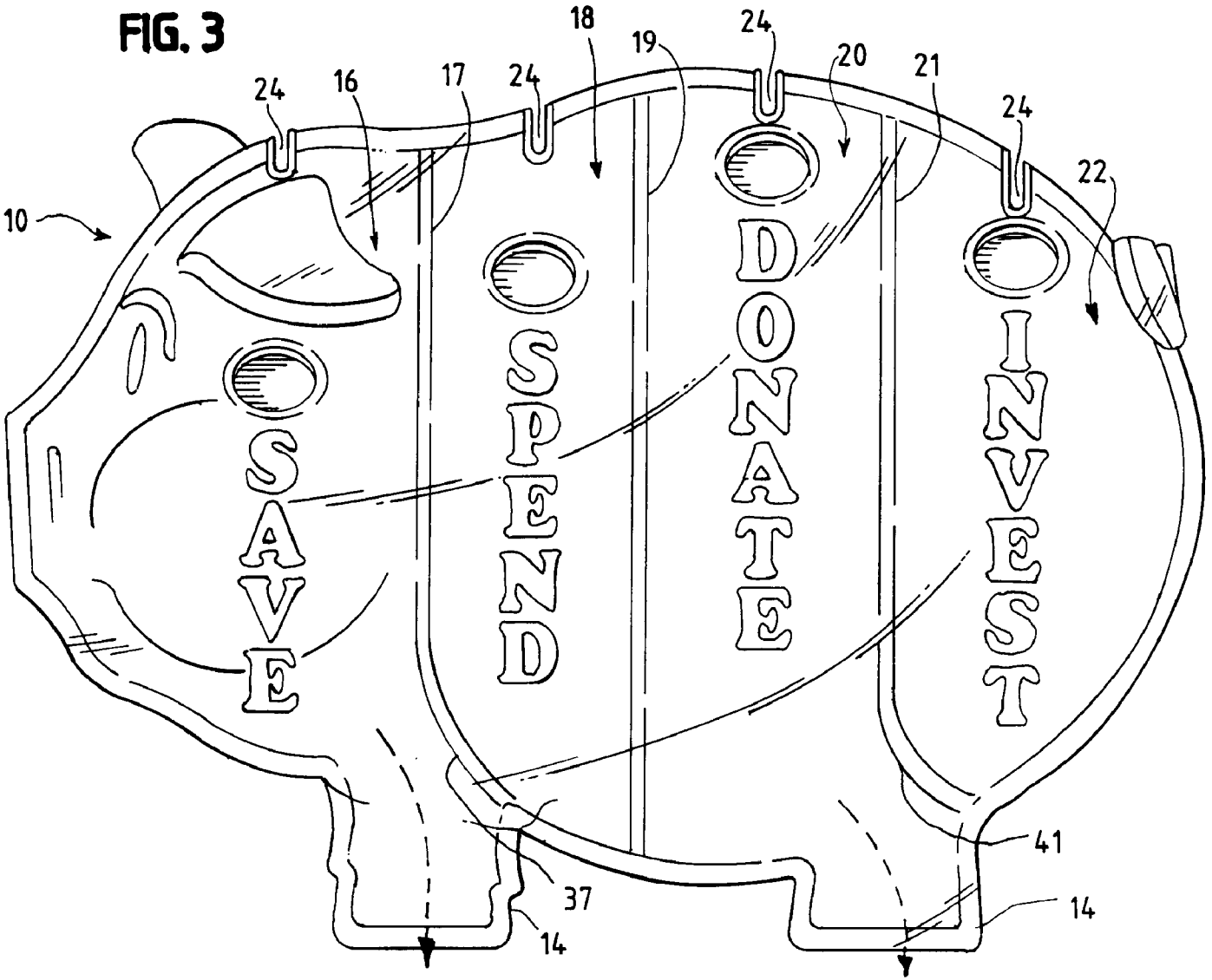
FIG. 3 is a left side elevational view of the bank of FIG. 1.
Figure 4:
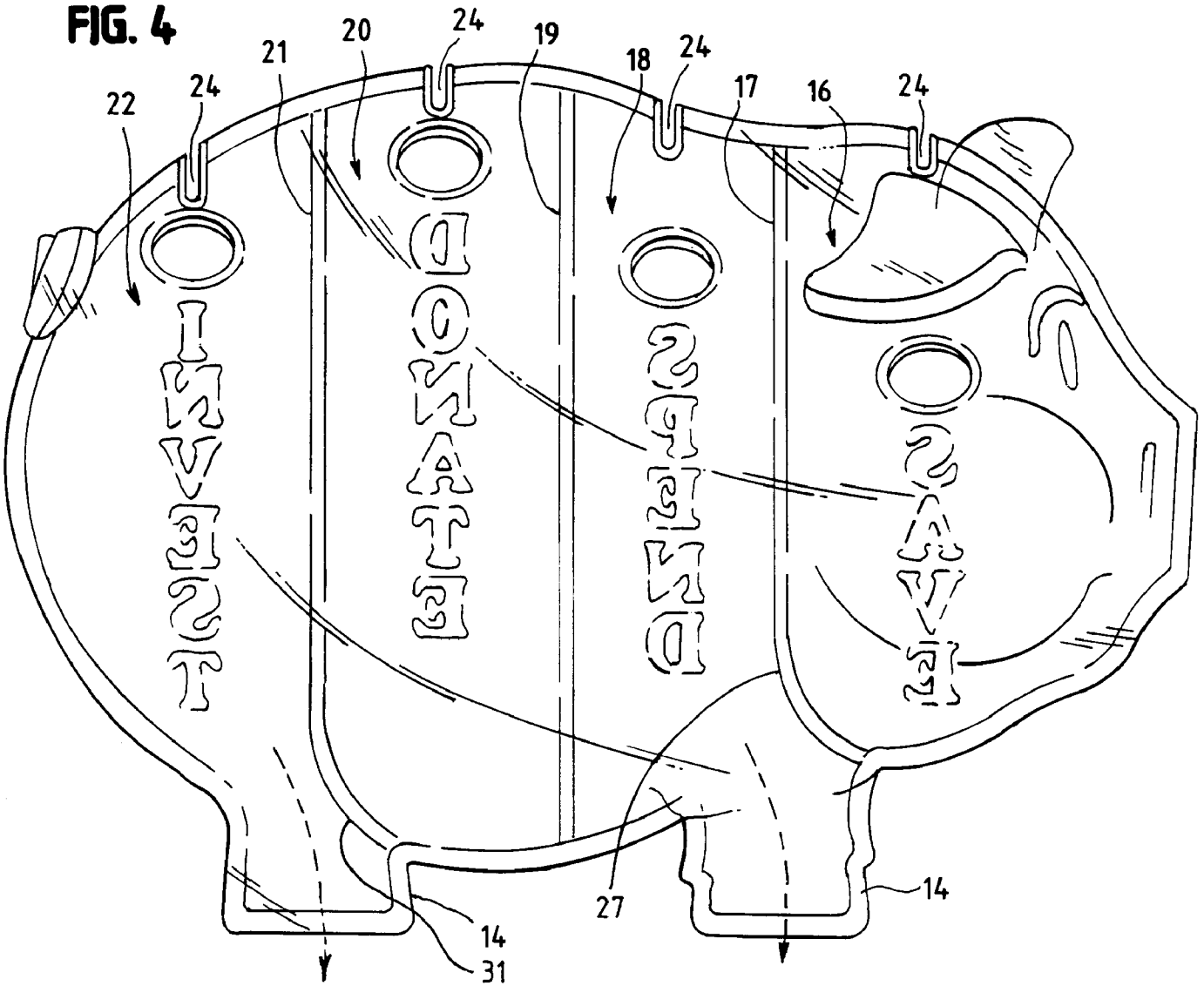
FIG. 4 is a right side elevational view of the bank of FIG. 1.
Figure 5:
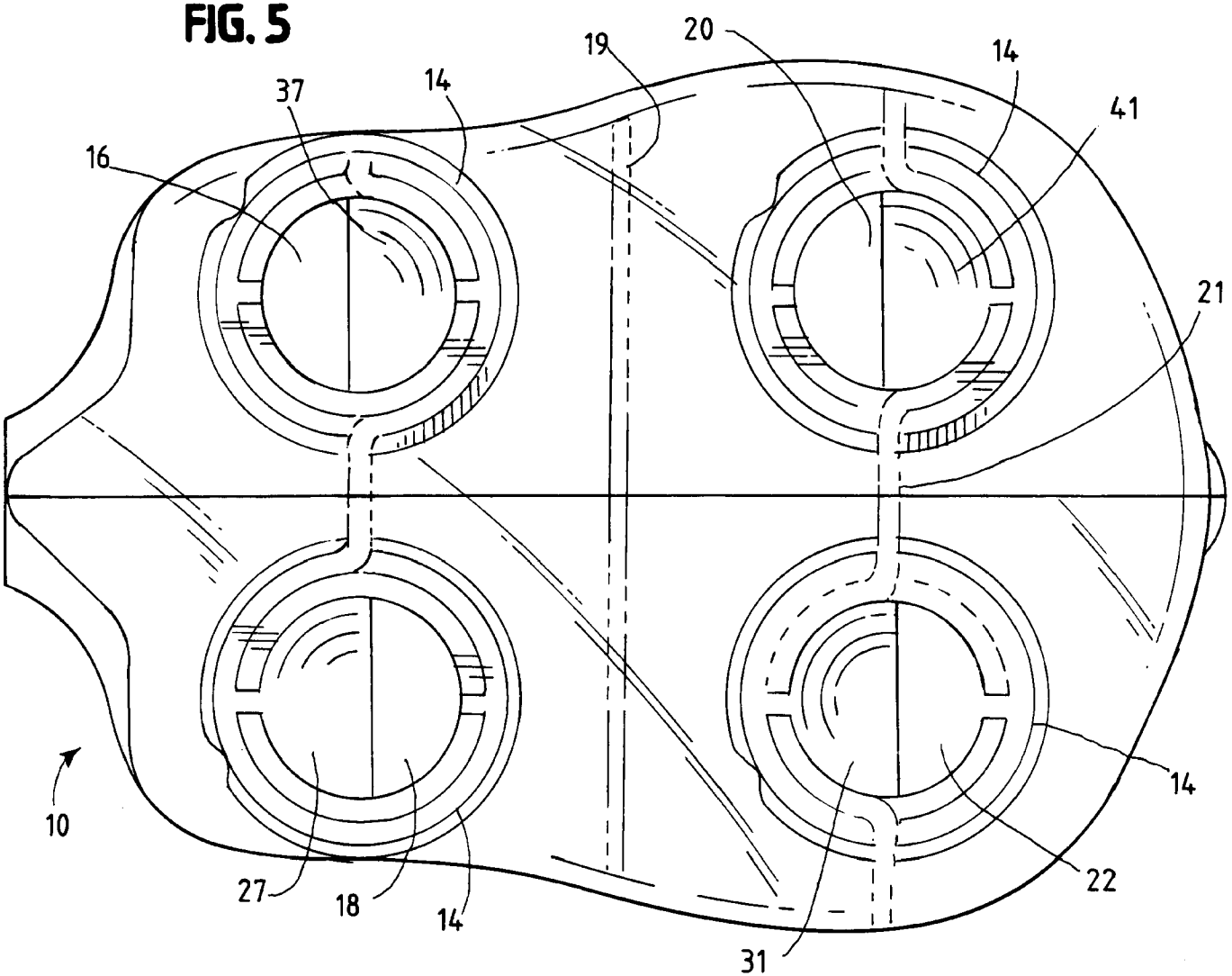
FIG. 5 is a bottom view of the bank of FIG. 1.
Figure 6:
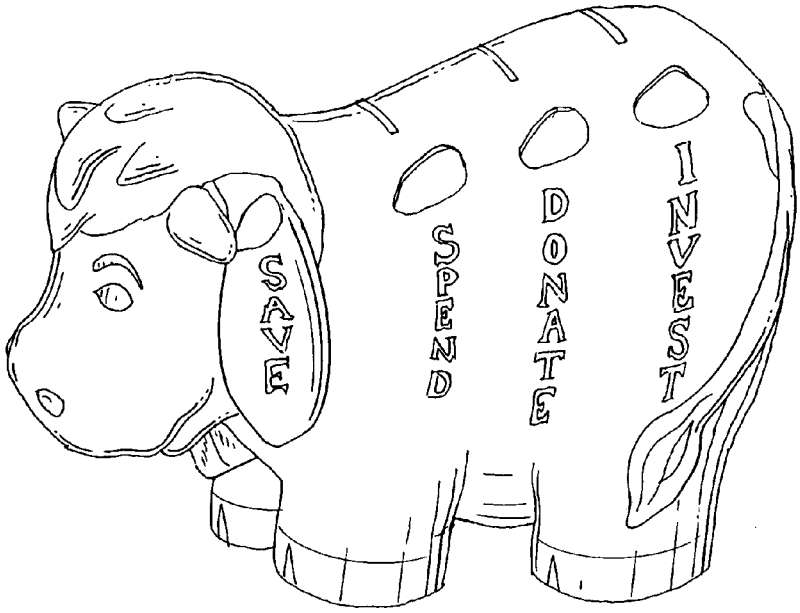
FIG. 6 is a perspective view of a second embodiment of a compartmented bank according to the present invention.
Figure 7:
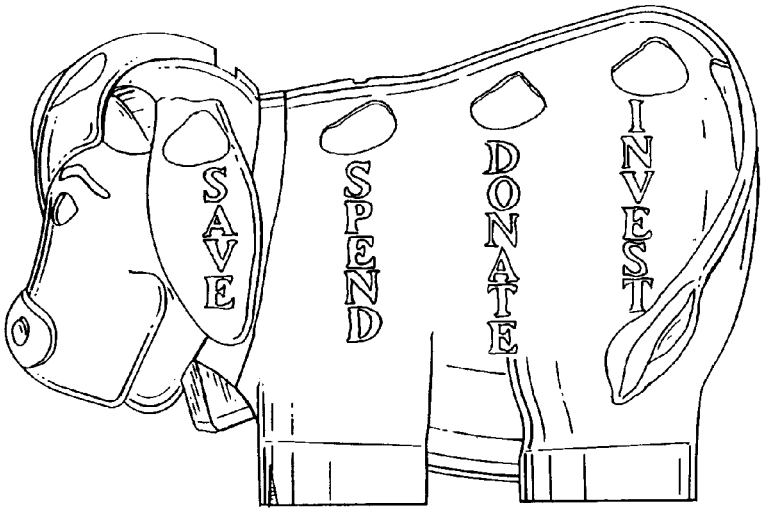
FIG. 7 is a left side elevational view of the bank of FIG. 6.
Figure 8:
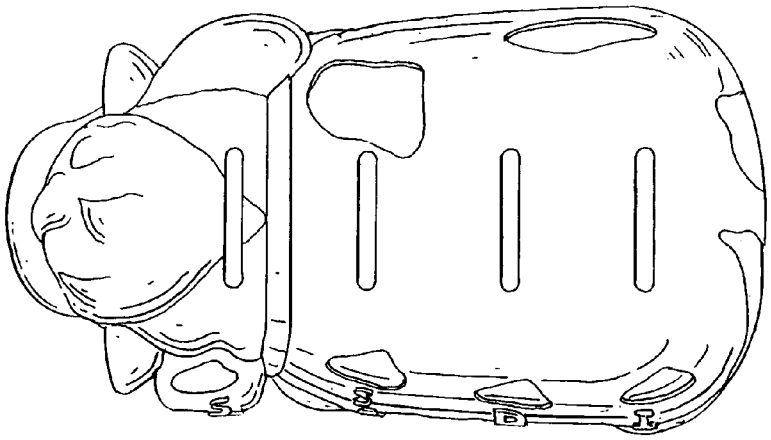
FIG. 8 is a top view of the bank of FIG. 6.

Turning to the drawings, there is shown in FIGS. 1–5 one embodiment of a compartmented bank according to the present invention. The bank 10 comprises a hollow body 12 shaped like an animal—preferably a pig—having a plurality of feet 14 or other appendages extending generally downward from the body 12.

The body 12 is divided by substantially planar internal walls into a plurality of compartments. For example, in the illustrated embodiment, the body 12 is divided into four compartments 16, 18, 20 and 22 by three internal walls 17, 19 and 21. The first, forward wall 17 divides the first compartment 16 and the second compartment 18. A third wall 21 divides the third compartment 20 and the fourth compartment 22. A second wall 19, disposed between the first wall 17 and the third wall 21, divides the second compartment 18 and the third compartment 20.

The body 12 is provided with slots 24 on its upper surface that communicate with each compartment. The body 12 bears or is otherwise marked with indicia 26 near each slot 24 to indicate the budgetary purpose of the corresponding compartment. For example, in the illustrated embodiment the indicia consists of the words "SAVE", "SPEND", "DONATE" and "INVEST", although other appropriate words or symbols can be used. The user deposits money, either coins or bills, into the slot corresponding to the particular purpose for which that money is to be used. The body 12 preferably is translucent so that the deposited money can be readily seen through the body 12.

In a key aspect of the invention, the bank 10 dispenses the money out openings in the feet 14. Each compartment 16, 18, 20, 22 communicates with one of the feet 14 so that money deposited into that compartment can be dispensed through the opening in that foot 14. When money is not being dispensed, the openings are closed with flexible plugs or any other suitable closing means.

As best shown in FIGS. 2–5, the front two feet 14 straddle a plane defined by the first wall 17 and the rear two feet 14 straddle a plane defined by the third wall 21. The first wall 17 is configured such that just one of the front feet 14 communicates with the first compartment 16 and the other front foot 14 communicates with the second compartment 18. Similarly, the third wall 21 is configured such that just one of the rear feet 14 communicates with the third compartment 20 and the other rear foot 14 communicates with the fourth compartment 22.

The first wall 17 has a portion 37 that curves rearward so that the first ("SAVE") compartment 16 communicates with the left front foot 14 and a portion 27 that curves forward so that the second ("SPEND") compartment 18 communicates with the right front foot 14. Similarly, the third wall 21 has a portion 41 that curves rearward so that the third ("DONATE") compartment 20 communicates with the left rear foot 14 and a portion 31 that curves forward so that the fourth ("INVEST") compartment 22 communicates with the right rear foot 14. In order to dispense money from, say, the third ("DONATE") compartment, the user opens the left rear foot by removing the plug or other closing means. (Of course, other configurations, for example, where the first compartment communicates with the right front foot, etc., are also possible. ) Indicia may be placed on the feet of the animal to facilitate dispensing from the correct compartment.

Thus there has been provided a bank for holding coins to be used for various budgetary purposes. Unlike previous compartmented banks, the present invention dispenses money through feet which communicate with corresponding compartments. The external surface of the bank bears indicia indicating the purpose to which the money is being saved. The bank is particularly useful in teaching young persons how to manage money.

Although the invention has been described in terms of a piggy bank, it should be understood that the bank body can be shaped like any animal having a plurality of feet or other appendages, such as a cow, horse, lamb, dog or fish.

Other modifications and alternative embodiments of the invention are contemplated which do not depart from the scope of the invention as defined by the foregoing teachings and appended claims. It is intended that the claims cover all such modifications that fall within their scope.

What is claimed is:

1. A bank for holding money, the bank shaped like an animal and comprising:

a hollow body divided into a plurality of compartments by internal walls, the body having a plurality of slots disposed therein such that one slot communicates with each compartment; and a plurality of feet, each foot corresponding to and communicating with one of the compartments;

wherein the money is dispensed through the feet and wherein the bank has two front feet and two back feet on opposing sides of the body.

2. The bank of claim 1 wherein the body is divided into four compartments by three walls, a first wall dividing a first compartment and a second compartment, a third wall dividing a third compartment and a fourth compartment, and a second wall disposed between the first wall and the third wall dividing the second compartment and the third compartment.

3. The bank of claim 2 wherein the front two feet straddle a plane defined by the first wall and the rear two feet straddle a plane defined by the third wall, the first wall configured such that one of the front feet communicates with the first compartment and the other front foot communicates with the second compartment, the third wall configured such that one of the rear feet communicates with the third compartment and the other rear foot communicates with the fourth compartment.

4. The bank of claim 3 wherein the first wall has a portion that curves rearward so that the first compartment communicates with the one of the front feet and a portion that curves forward so that the second compartment communicates with the other front foot and the third wall has a portion that curves rearward so that the third compartment communicates with one of the rear feet and a portion that curves forward so that the fourth compartment communicates with the other rear foot.

5. The bank of claim 4 wherein the body bears indicia corresponding to each compartment to indicate the budgetary purpose of the money placed in each compartment.

6. The bank of claim 5 wherein the animal is a pig.

7. The bank of claim 5 wherein the animal is a cow.

* * * * *